US010337226B2

(12) United States Patent
Warren

(10) Patent No.: US 10,337,226 B2
(45) Date of Patent: Jul. 2, 2019

(54) CASEMENT WINDOW HINGE WITH ENHANCED PULLOUT RESISTANCE

(71) Applicant: All Metal Stamping, Inc., Abbotsford, WI (US)

(72) Inventor: Kelly Warren, Wausau, WI (US)

(73) Assignee: All Metal Stamping, Inc., Abbotsford, WI (US)

( * ) Notice: Subject to any disclaimer, the term of this patent is extended or adjusted under 35 U.S.C. 154(b) by 0 days.

(21) Appl. No.: 15/787,969

(22) Filed: Oct. 19, 2017

(65) Prior Publication Data

US 2018/0112448 A1 Apr. 26, 2018

Related U.S. Application Data

(60) Provisional application No. 62/410,594, filed on Oct. 20, 2016.

(51) Int. Cl.
*E05D 15/00* (2006.01)
*E05D 15/30* (2006.01)
*E06B 3/50* (2006.01)

(52) U.S. Cl.
CPC ..... *E05D 15/30* (2013.01); *E06B 3/5018* (2013.01); *E05Y 2900/148* (2013.01)

(58) Field of Classification Search
CPC ..... Y10T 16/545; Y10T 16/5453; Y10T 16/5457; Y10T 16/547; Y10T 16/6298; Y10T 16/551; E05Y 2900/148; E05Y 2800/696; E05D 15/30; E05D 15/406; E05D 15/408; E05D 15/42; E05D 15/44; E05D 15/16; E05D 15/165; E05D 3/18; E05D 13/08; E05D 13/10; E05F 11/00; E05F 11/34; E06B 3/5018
See application file for complete search history.

(56) References Cited

U.S. PATENT DOCUMENTS 3,097,402 A * 7/1963 Ewing ..... E06B 3/50 16/93 R
3,156,955 A * 11/1964 Lindstedt ..... E06B 3/50 16/93 R
5,040,267 A * 8/1991 Dallmann ..... E05D 15/30 16/235
5,964,011 A * 10/1999 Ruston ..... E05D 7/0054 16/239
6,442,899 B1 * 9/2002 Gledhill ..... E05D 15/44 49/161
7,181,805 B2 * 2/2007 Tremblay ..... E05D 7/04 16/193
2011/0107678 A1 * 5/2011 Bauman ..... E05D 15/30 49/506
2011/0131763 A1 * 6/2011 La See ..... E05D 15/30 16/364
2013/0198997 A1 * 8/2013 Olson ..... E05D 15/30 16/364

* cited by examiner

*Primary Examiner* — Chuck Y Mah
(74) *Attorney, Agent, or Firm* — Boyle Fredrickson S.C.

(57) ABSTRACT

A casement window hinge provides a shoe sliding on a track to support a sash arm. The shoe is held captive within the track against outward movement by a T-bar extending rearwardly from the shoe and retained by upwardly and downwardly extending flanges from the track.

16 Claims, 3 Drawing Sheets

CASEMENT WINDOW HINGE WITH ENHANCED PULLOUT RESISTANCE

CROSS REFERENCE TO RELATED APPLICATION

This application claims the benefit of U.S. Provisional application 62/410,594 filed Oct. 20, 2016, and hereby incorporated in its entirety.

BACKGROUND OF THE INVENTION

The present invention relates to casement window hinges and in particular to a casement window hinge better resisting pullout, for example, caused by increased window weight.

Casement window hinges allow a window to open by pivoting about a vertical axis that moves inward as the window opens. This combination motion is provided by special casement window hinges that slide along a track supporting the window sash. A separate operator moves the window as mounted on the hinges, typically using a crank mechanism.

Casement window hinges typically employ a two-bar linkage of a sash arm and guide arm. The sash arm is attached along the window sash, for example, by countersunk wood screws directed up through the sash arm into the wood or other material of the sash. An inward end of the sash arm is pivotally attached to a slide or "shoe" that may move along the track attached to the window opening and that defines the movable pivot point or hinge point of the window. A center of the sash arm is pivotally attached to one end of a guide arm. The remaining end of the guide arm is pivotally attached to the track displaced from the slide.

Normally each window is supported by two casement window hinges on corresponding shoes, one positioned at a lower edge of the window and the other positioned at the upper edge of the window, the hinges being generally mirror images of each other. Increased interest in energy conservation has led to the introduction of triple glazed windows providing three layers of glass separated by air gaps. Triple glazed windows have substantially higher weight than so-called double pane windows and can exert substantial outward lateral threes on the casement window shoe leading to premature failure and pullout of the shoe from the track. This can also be true for large windows or windows that have greater weight.

BRIEF SUMMARY OF THE INVENTION

The present invention provides a T-bar engagement between the track and the shoe providing an increased sliding contact area against lateral forces reducing both wear and the possibility of pullout of the shoe in a lateral direction. A channel surface for a lower arm of the T-bar is provided through the use of a fence strip attached to the bottom of the track fitting within an undercut bridge portion of the shoe, the latter placed to provide clearance with respect to the screws holding the track to the windowsill.

More specifically, the invention provides a casement window hinge having a longitudinally extending track attachable to a window opening, the track providing a horizontal track surface and a first capture flange being proximate to the horizontal track surface and extending vertically away from the track surface and a second capture flange removed from the track surface and extending vertically toward the track surface. A shoe having a first slide surface abuts the horizontal track surface to slide longitudinally therealong, the shoe further providing first and second opposed, vertically extending projections engaging respective of the first and second capture flanges in sliding contact to allow the shoe to move longitudinally therealong while being constrained against outward motion perpendicular to the longitudinal extent of the track. A sash arm pivotally attaches to the shoe at one end and extends therefrom for attachment to a window sash, and a guide arm pivotally attaches at one end of the longitudinally extending track and pivotally attaches at another end to the sash arm.

It is thus a feature of at least one embodiment of the invention to provide a casement window hinge that can better handle improved energy saving windows or other windows of greater weight.

The longitudinally extending track may be an L-shaped metal channel having first and second perpendicularly extending walls where the first wall provides the horizontal track surface and the second wall is positioned rearwardly to extend vertically away from the horizontal track surface at a rear edge of the horizontal track surface, and wherein the second capture flange is an upper edge of the second wall rolled to extend toward the horizontal track surface.

It is thus a feature of at least one embodiment of the invention to provide an improved hinge that may make use of existing technology for track fabrication using a rolled lip.

The casement window hinge may further include a fence strip attached to the horizontal track surface, and wherein the first capture flange may be a vertically extending lip formed at an inner edge of the fence strip.

It is thus a feature of at least one embodiment of the invention to provide two surfaces of opposed shoe engagement from simple formed shapes of robust strips.

The shoe may provide a longitudinal channel proximate to the horizontal track surface separating the first slide surface from a second slide surface, both in sliding contact with the horizontal track surface, and wherein the second slide surface fits between the first capture flange and the second perpendicularly extending rear wall to be constrained against inward and outward motion perpendicular to the longitudinal extent of the track. The first projection may provide the second slide surface.

It is thus a feature of at least one embodiment of the invention to provide improved pullout resistance without significant reduction in the separation width of the sliding contact areas such as provides improved stability against rocking of the shoe.

The fence strip may fit within the longitudinal channel.

It is thus a feature of at least one embodiment of the invention to provide improved pullout resistance without increasing the height of the shoe.

The fence strip and horizontal track surface may have holes therethrough for attachment of the track to a window.

It is thus a feature of at least one embodiment of the invention to displace screw heads and holes from contact with the shoe such as might otherwise provide points of resistance or wear.

The fence strip and horizontal track surface may be individual stainless-steel strips formed and attached together.

It is thus a feature of at least one embodiment of the invention to provide a casement window hinge with improved pull-out resistance that can be effectively fabricated from stainless steel elements resistant to corrosion.

The shoe may be fabricated at least in part from a polymer material exposed at the first and second slide surfaces to provide contact between the first and second slide surfaces and the horizontal track surface and exposed at the first and second projections to provide contact between the first and second projections and the first and second capture flanges.

It is thus a feature of at least one embodiment of the invention to provide low friction between the shoe in sliding contact with the track against both vertical and outward loading of the shoe.

The shoe may include a metal framework within the polymer material providing a T-frame having a horizontally extending stem positioned over the first slide surface and longitudinal channel perpendicular and having T-arms extending vertically into the first and second projections to reinforce the same.

It is thus a feature of at least one embodiment of the invention to increase the ability of thin cross-sections of polymer material to handle substantial bending loads thereby providing a compact but robust shoe.

The shoe may include a bore exposing an undersurface of the stem portion to abut a rivet head of a rivet extending upwardly through a hole in the stem portion to pivotally attach to the sash arm.

It is thus a feature of at least one embodiment of the invention to employ the stem to spread the point contact forces of the rivet over the polymer body of the shoe.

The polymer material may provide an overlying polymer layer positioned above the upper surface of the stem portion positioned between the stem portion and the sash arm around the rivet.

It is thus a feature of at least one embodiment of the invention to provide a low friction material at the point of pivoting of the sash arm against the shoe.

The polymer material may be injection molded around the metal framework.

It is thus a feature of at least one embodiment of the invention to provide a design that can be readily fabricated in injection molding.

The metal framework maybe folded from a single strip of metal.

It is thus a feature of at least one embodiment of the invention to permit the use of lightweight and strong strip forms of metal in the fabrication of the hinge track.

These particular features and advantages may apply to only some embodiments falling within the claims and thus do not define the scope of the invention.

DETAILED DESCRIPTION OF THE INVENTION

Figure 1:
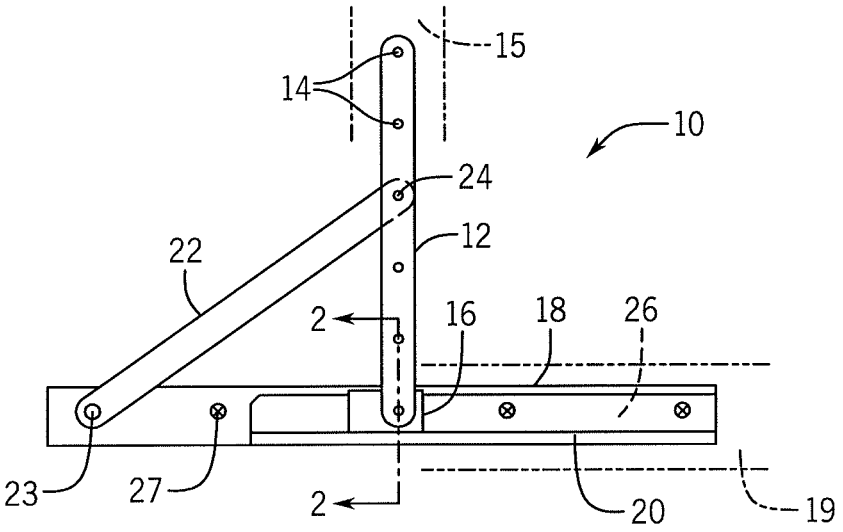
FIG. 1 is a top plan view of the casement window hinge showing the sash arm, guide arm, shoe, fence strip and track of the present invention.

Referring now to FIG. 1, a casement window hinge 10 may include a sash arm 12 that may be attached to a window sash 15 by means of mounting holes 14 receiving countersunk head wood screws (not shown in FIG. 1) upward through the sash arm 12. A proximal end of the sash arm 12 is pivotally attached to a shoe 16 that may move along a length of a metal track 18. The shoe 16 is retained by a rolled edge 20 in the metal track 18 and a fence strip 26 as will be discussed in more detail below.

A proximal end of a guide arm 22 is pivotally attached to the track 18 at a pivot 23 on the track 18 removed from the travel range of the shoe 16, and a distal end of the guide arm 22 is pivotally attached to a midpoint of the sash arm 12 at a second pivot 24. The sash arm 12 and guide arm 22 form a two-bar linkage providing a simultaneous pivoting and translation of an attached window sash. The general structure of hinges of this type is described in U.S. Pat. Nos. 6,088,880 and 8,495,797 to LaSee, assigned to the assignee of the present invention and hereby incorporated by reference.

As noted, a fence strip 26 is placed on top of the horizontal upper surface of the track 18 to complement the rolled edge 20 for retaining the shoe 16 as will be described. The fence strip 26 may be tack welded, for example, by spot welding to the track 18 and/or attached by screws 27 passing through the horizontal extent of the fence strip 26 and track 18 into the sill 19. The track 18 and fence strip 26 may be constructed of strips of stainless steel folded by roller forming or other folding techniques for simple manufacture.

Figure 2:
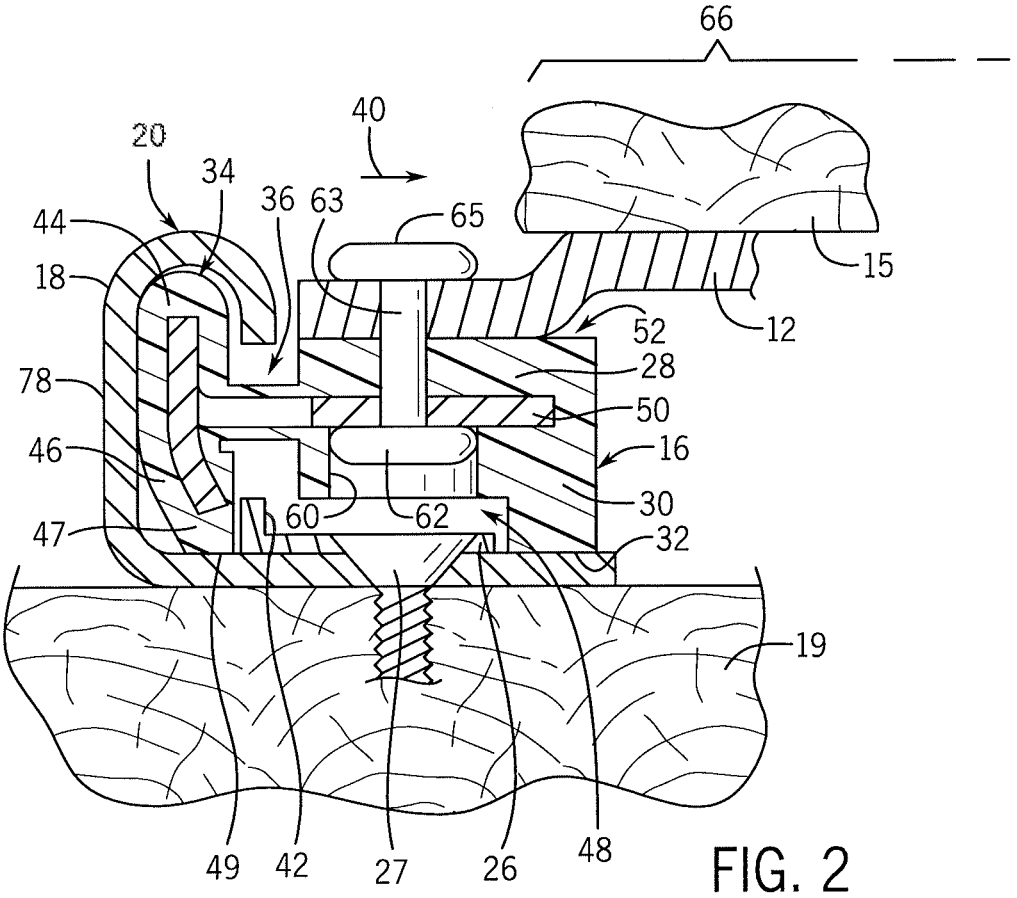
FIG. 2 is a fragmentary cross-sectional view taken along line 2-2 of FIG. 1 showing the T-bar engagement between the shoe and the track and the fence strip providing retention of the T-bar.

Referring now also to FIG. 2, the shoe 16 may provide a main body 28 having a downwardly extending front ridge 30 terminating at a horizontal sliding surface 32 contacting an upper surface of the track 18 at its outer edge and extending generally along the axis of the track 18. The main body 28 is connected at its rear edge to a T-bar 34, the latter oriented horizontally and spaced inwardly away from the main body 28 as joined by a horizontal narrow bar 36.

Opposed vertically extending arms of the T-bar 34 are positioned beneath the downwardly concave surface of the rolled edge 20. Specifically, an upwardly extending upper arm 44 of the T-bar 34 is retained against lateral force indicated by arrow 40 by a downward lip of the rolled edge 20. Conversely, downwardly extending lower arm 46 of the T-bar 34 is retained by an upwardly extending flange 42 formed in a rear edge of the fence strip 26 extending along the axis of the track 18. Desirably, the upwardly extending flange 42 presents a surface generally parallel to and abutting an opposed surface of the lower arm 46 of the T-bar 34 to provide a broad area of contact therebetween.

The downwardly extending lower arm 46 of the T-bar 34 terminates at a downwardly extending rear rim 47 abutting the upper horizontal rim of the track 18 inwardly from the surface 32 at a sliding surface 49, supporting the shoe 16 to slide along the upper surface of the track 18.

The shoe 16 provides a bridge region 48 over the upper surface of the track 18 between the sliding surfaces 49 and 32 removed from the surface of the track 18 preventing contact or interference between the shoe 16 and the screws 27 and/or the fence strip 26.

Figure 4A:
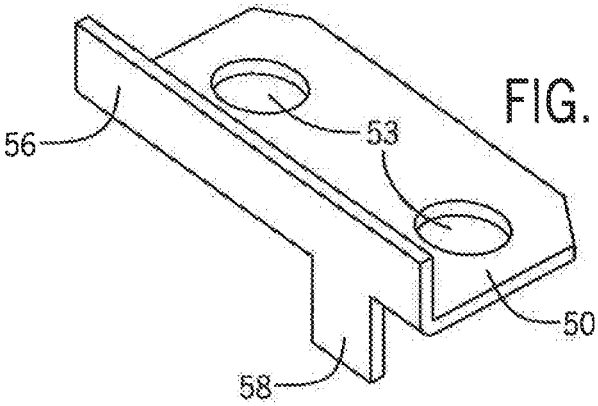
FIGS. 4*a* and 4*b* are perspective front and rear views of a metallic spine molded into the shoe to provide greater strength.
Figure 4B:
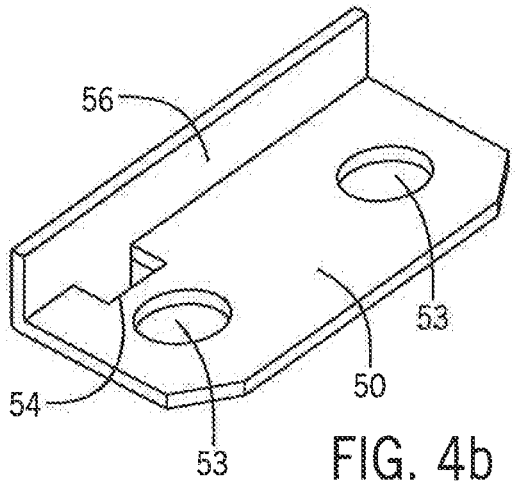
Figure 5A:
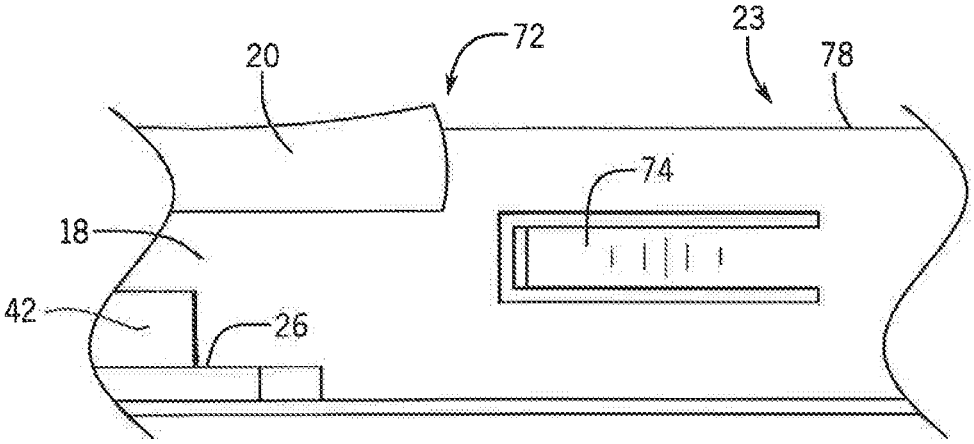
FIGS. 5*a* and 5*b* are front fragmentary elevational and top plan views of a portion of the track showing a flaring of the track at an entrance point for receiving the shoe and a resilient stop to prevent accidental disengagement of the shoe from the track.
Figure 5B:
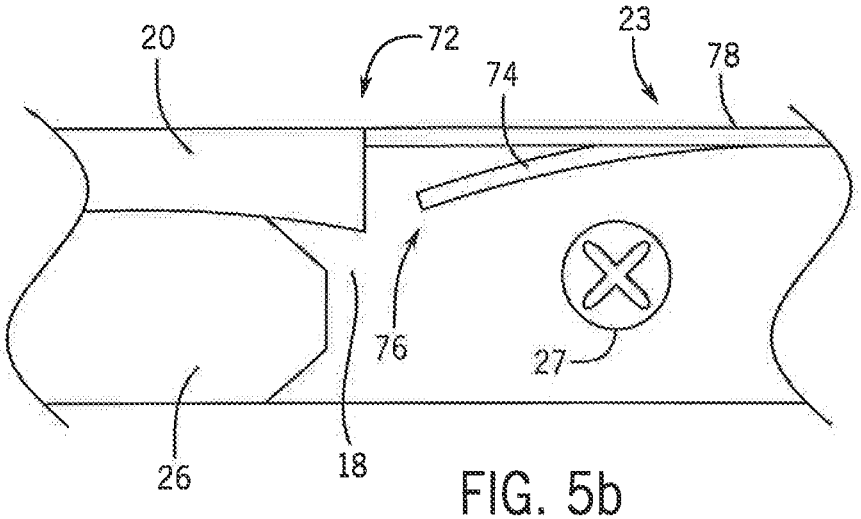

Referring also to FIG. 4, the shoe 16 may be an injection molded thermoplastic material over a metallic spine 50, the latter having a horizontal portion embedded within the shoe 16 below an upper surface 52 of the shoe 16, spanning the bridge region 48 and extending through the narrow bar 36 into the T-bar 34. The metallic spine 50 may, for example, be formed from a strip of steel and may include holes 53 for passage of a rivet to be described. The exposed thermoplastic material may provide natural lubricity or be lubricated at places where it contacts the track 18. A rearward edge of the strip of metallic spine 50 is folded vertically upward providing an upper rim 56 extending into the upper arm 44 of the T-bar 34. A cutout 54 is provided in the horizontal portion of the metallic spine 50 near the upper rim 56 releasing a tab 58 that may swing downwardly when the rearward edge of the strip of the metallic spine 50 is folded vertically. This tab 58 projects downwardly toward the lower arm 46 of the T-bar 34.

Referring again to FIG. 2, the metallic spine 50 will generally have a portion parallel to but positioned below the horizontal upper surface 52 of the track 18 and above the sliding surfaces 32 and 49 so that contact with the track 18 and the sash arm 12 is through the thermoplastic material providing improved lubricity and reduced wear.

A lower surface of the shoe 16 in the bridge region 48 may have a counterbore 60 receiving the head 62 of a rivet 63 so that the head 62 may fit against a lower surface of the metallic spine 50. The rivet body may then pass upwardly through the shoe 16 out of the upper surface 52 and through a corresponding bore in the proximal end of the sash arm 12 so that the sash arm is pivotally retained against the shoe by a second rivet head 65.

The sash arm 12 proceeding horizontally away from the pivot point of the rivet 63 is offset upward through a dog-leg bend to so that an area of contact 66 between the upper surface of the sash area 12 and the lower surface of the sash 15 is above the rivet head 65 and the rolled edge 20 preventing interference therebetween.

Figure 3:
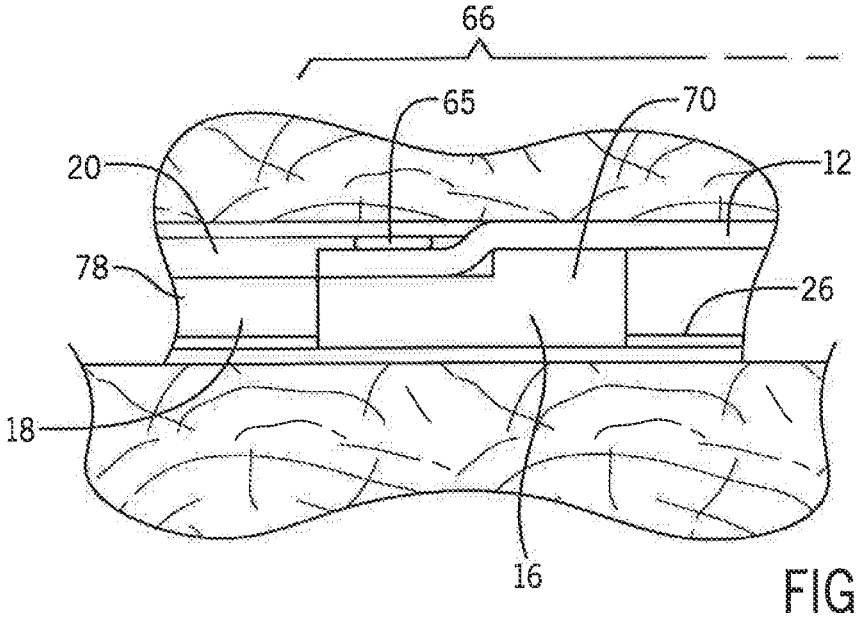
FIG. 3 is a front elevational view in fragment of the shoe of the casement window hinge when the window is in the closed position showing support of the sash on an elevated portion of the shoe during shipping.

Referring now to FIG. 3, a portion of the shoe 16 removed from the rivet head 65 may provide an elevated support surface 70 abutting and supporting the under surface of the sash arm 12 in the area of contact 66 when the sash arm 12 is in a closed position to reduce damage to the casement window hinge 10 during shipping, for example.

Referring now to FIGS. 1, 2, 5*a* and 5*b*, a portion of the rolled edge 20 toward the pivot 23 may be expanded in a flare 72 to assist in engagement between the T-bar 34 of the shoe 16 and the roiled edge 20 during assembly of the casement window hinge 10. The flange 42 of the fence strip 26 may be offset from this flare 72 by a further distance away from pivot 23 to also assist in engagement of the T-bar 34 of the shoe 16.

Removal of the shoe 16 from engagement with the rolled edge 20 and the fence strip 26 as it moves toward the pivot 23 is resisted by a cantilevered spring tab 74, for example, being a partially cut-out portion of a vertical rear wall 78 of the track 18 flexing inwardly to provide a stop end 76 that resists removal of this shoe 16 unless the stop end 76 is first pressed inward to be aligned with a vertical rear wall 78 of the track 18.

Certain terminology is used herein for purposes of reference only, and thus is not intended to be limiting. For example, terms such as "upper", "lower", "above", and "below" typically refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence, or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A casement window hinge comprising:

a longitudinally extending track attachable to a window opening, the track providing a horizontal track surface and a first capture flange being proximate to the horizontal track surface and extending vertically away from the track surface and a second capture flange removed from the track surface and extending vertically toward the track surface;

a shoe having a first slide surface abutting the horizontal track surface to slide longitudinally therealong, the shoe further providing first and second opposed, vertically extending projections positioned to engage respective of the first and second capture flanges in sliding contact to allow the shoe to move longitudinally therealong while being constrained against outward motion perpendicular to the longitudinal extent of the track;

a sash arm pivotally attached to the shoe at one end and extending therefrom for attachment to a window sash; and a guide arm pivotally attached at one end of the longitudinally extending track and pivotally attached at another end to the sash arm wherein the first capture flange extends substantially a full sliding range of the shoe along the longitudinally extending track defined by an engagement of the shoe to the longitudinally extending track.

2. The casement window hinge of claim 1 wherein the longitudinally extending track is an L-shaped metal channel having a first and second perpendicularly extending wall, wherein the first wall provides the horizontal track surface and the second wall is positioned rearwardly to extend vertically away from the horizontal track surface from a rear edge of the horizontal track surface and wherein the second capture flange is an upper edge of the second wall rolled to extend toward the horizontal track surface to be constrained against.

3. The casement window hinge of claim 1 wherein the shoe provides a longitudinal channel proximate to the horizontal track surface separating the first slide surface from a second slide surface, both in sliding contact with the horizontal track surface, and wherein the second slide surface fits between the first capture flange and a second perpendicularly extending rear wall to be constrained against inward and outward motion perpendicular to the longitudinal extent of the track.

4. The casement window hinge of claim 3 wherein the first projection provides the second slide surface.

5. The casement window hinge of claim 3 wherein the fence strip fits within the longitudinal channel.

6. The casement window hinge of claim 3 wherein the shoe is fabricated at least in part from a polymer material exposed at the first and second slide surfaces to provide contact between the first and second slide surfaces and the horizontal track surface and exposed at the first and second projections to provide contact between the first and second projections and the first and second capture flanges.

7. The casement window hinge of claim 6 further including a metal framework within the polymer material providing a T-frame having a horizontally extending stem positioned over the first slide surface and the longitudinal channel and perpendicular T-arms extending vertically into the first and second projections to reinforce the same.

8. The casement window hinge of claim 7 further including a bore exposing an undersurface of the stem to abut a rivet head of a rivet extending upwardly through a hole in the stem portion to pivotally attach to the sash arm.

9. The casement window hinge of claim 8 wherein the polymer material provides an overlying polymer layer positioned above an upper surface of the stem portion positioned between the stem portion and the sash arm around the rivet.

10. The casement window hinge of claim 7 wherein a polymer material is injection molded around the metal framework.

11. The casement window hinge of claim 7 wherein the metal framework is folded from a single strip of metal.

12. A casement window hinge of claim 1 wherein the shoe provides a main body pivotally attached to the sash arm and having a rearwardly extending T-bar with a span of the T-bar attached to the main body and extending horizontally therefrom and arms of the T-bar providing the first and second opposed vertically extending projections.

13. A casement window hinge comprising:

a longitudinally extending track attachable to a window opening, the track providing a horizontal track surface and a first capture flange being proximate to the horizontal track surface and extending vertically away from the track surface and a second capture flange removed from the track surface and extending vertically toward the track surface;

a shoe having a first slide surface abutting the horizontal track surface to slide longitudinally therealong, the shoe further providing first and second opposed, vertically extending projections positioned to engage respective of the first and second capture flanges in sliding contact to allow the shoe to move longitudinally therealong while being constrained against outward motion perpendicular to the longitudinal extent of the track:

a sash arm pivotally attached to the shoe at one end and extending therefrom for attachment to a window sash;

a guide arm pivotally attached at one end of the longitudinally extending track and pivotally attached at another end to the sash arm; and a fence strip attached to the horizontal track surface and wherein the first capture flange is a vertically extending lip formed at an inner edge of the fence strip.

14. The casement window hinge of claim 13 wherein the fence strip and horizontal track surface have holes therethrough for attachment of the track to a window.

15. The casement window hinge of claim 14 wherein the fence strip and horizontal track surface are individual stainless-steel strips formed and attached together.

16. A casement window hinge comprising:

a longitudinally extending track attachable to a window opening, the track providing a horizontal track surface and a first capture flange being proximate to the horizontal track surface and extending vertically away from the track surface and a second capture flange removed from the track surface and extending vertically toward the track surface;

a shoe having a first slide surface abutting the horizontal track surface to slide longitudinally therealong, the shoe further providing first and second opposed, vertically extending projections positioned to engage respective of the first and second capture flanges in sliding contact to allow the shoe to move longitudinally therealong while being constrained against outward motion perpendicular to the longitudinal extent of the track;

a sash arm pivotally attached to the shoe at one end and extending therefrom for attachment to a window sash; and a guide arm pivotally attached at one end of the longitudinally extending track and pivotally attached at another end to the sash arm wherein the shoe is fabricated at least in part from a metal T-frame having a horizontally extending stem positioned over the first slide surface and perpendicular T-arms extending vertically into the first and second projections to reinforce the same and overmolded by a polymer material exposed at the first slide surface to provide contact between the first slide surface and the horizontal track surface and exposed at the first and second projections to provide contact between the first and second projections and the first and second capture flanges.

* * * * *